US012601136B2

(12) United States Patent
Kropidłowski et al.

(10) Patent No.: US 12,601,136 B2
(45) Date of Patent: Apr. 14, 2026

(54) MONOPILE FOUNDATION AND METHOD FOR INSTALLATION OF A MONOPILE FOUNDATION

(71) Applicants: Arkadiusz Kropidłowski, Gdansk (PL); Piotr Berent, Szczecin (PL)

(72) Inventors: Arkadiusz Kropidłowski, Gdansk (PL); Piotr Berent, Szczecin (PL)

( * ) Notice: Subject to any disclaimer, the term of this patent is extended or adjusted under 35 U.S.C. 154(b) by 79 days.

(21) Appl. No.: 18/563,247

(22) PCT Filed: May 19, 2022

(86) PCT No.: PCT/PL2022/000032
§ 371 (c)(1),
(2) Date: Nov. 21, 2023

(87) PCT Pub. No.: WO2022/250550
PCT Pub. Date: Dec. 1, 2022

(65) Prior Publication Data

US 2024/0247458 A1 Jul. 25, 2024

(30) Foreign Application Priority Data

May 24, 2021 (PL) ..... P.437944

(51) Int. Cl.
*E02D 27/52* (2006.01)
*E02B 17/02* (2006.01)
*E02B 17/00* (2006.01)

(52) U.S. Cl.
CPC ..... *E02D 27/525* (2013.01); *E02B 17/027* (2013.01); *E02B 2017/0043* (2013.01); *E02B 2017/0065* (2013.01)

(58) Field of Classification Search
CPC ..... E02B 2017/0065; E02D 27/525
See application file for complete search history.

(56) References Cited

U.S. PATENT DOCUMENTS

2014/0014388 A1 1/2014 Maier
2019/0234379 A1* 8/2019 Bartminn ..... E02B 17/027
2019/0334325 A1* 10/2019 Findeisen ..... H02B 1/56

FOREIGN PATENT DOCUMENTS

EP 2372143 A1 10/2011
EP 3103924 A1 12/2016
(Continued)

OTHER PUBLICATIONS

International Search Report mailed Sep. 9, 2022 in corresponding PCT International Application No. PCT/PL2022/000032.

*Primary Examiner* — Sean D Andrish
(74) *Attorney, Agent, or Firm* — OSTROLENK FABER LLP

(57) ABSTRACT

A monopile foundation in the form of a cylindrical steel pipe that can be driven into the bottom of a water basin. The monopole foundation includes a bottom area, and an area above the bottom area. The area above the bottom includes a connection flange, and a tight membrane consisting of a bottom panel and of a top panel with at least one reinforcing rib, and filling between the panels. Above the membrane, the monopile foundation contains dry functional space between the membrane and the top connection flange, while in the bottom area of the monopile foundation, below the bottom panel of the membrane, there are openings in the cylindrical steel pipe of the monopile foundation. The space between the bottom panel of the membrane and the top edge of the outlet openings is filled by an air cushion.

15 Claims, 11 Drawing Sheets

(56) References Cited

FOREIGN PATENT DOCUMENTS

| | | | |
|---|---|---|---|
| EP | 3502353 | A1 | 6/2019 |
| EP | 3795823 | A1 | 3/2021 |
| GB | 2584958 | A | 12/2020 |
| JP | 2020190152 | A | 11/2020 |
| WO | WO 03/095748 | A1 | 11/2003 |
| WO | WO 2010/103114 | A1 | 9/2010 |

* cited by examiner

MONOPILE FOUNDATION AND METHOD FOR INSTALLATION OF A MONOPILE FOUNDATION

CROSS-REFERENCE TO RELATED APPLICATIONS

The present application is a 35 U.S.C. §§ 371 national stage application of International Application No. PCT/PL2022/000032, filed May 19, 2022, which claims priority to Polish Patent Application No. P.437944, filed May 24, 2021, the contents of which are incorporated herein by reference.

FIELD OF THE INVENTION

The object of the invention is a monopile foundation for structures located in water basins and a method for installation of a monopile foundation at the bottom of the basin.

BACKGROUND OF THE INVENTION

The term monopile foundation should be understood as a cylindrical pipe made of bent metal sheets, joined inseparably using the welding technology. The monopile foundation comprises a foundation or a part of a foundation of an offshore type structure. The term basin should be understood as a freely defined saltwater or freshwater area. Such foundations provide a supporting structure, on which the working device is located and placed by vibrating and/or impulse penetration into the bottom of the basin. The monopile foundation is used as a foundation or a foundation element for structures using, for example, renewable energy sources, such as wind, solar energy or sea tides and currents. Working structures according to the invention include, in particular, wind turbines comprising power farms located in water basins in an offshore systems, trafo stations of floating photovoltaic farms.

There is a range of known foundation solutions in the form of a monopile foundation used for construction of offshore type working devices.

The solution known from the disclosure of the European patent EP 3103924A1 presents a monopile foundation for an offshore tower structure comprising of a fragment for tower installation and a basis, wherein the monopile foundation as a whole is partially anchored in the sea bottom, and the basis is circumferentially joined with the monopile foundation. The basis includes flange surrounding the edge of the monopile foundation. The invention also pertains to a method of foundation installation, comprising a vibration implantation of the monopile foundation into the bottom of the basin.

Another solution is known from the publication of the disclosure of the WO 03/095748A1 international application, which presented a foundation, intended in particular for an offshore wind turbine. The basis of the foundation has two or more branches spreading from the central supporting structure, where the load-bearing pillars are completely or mostly formed of steel sheet. The invention provides a simpler form of a structure for an offshore basis, replacing the currently used pipe-type steel elements, which have systems difficult for welding with a much more simple system intended for welding, with stronger strain points and strains which are easier to reduce. The strain points have been reinforced by using stiffening elements. It was shown that this known solution provides an adequate basis for an offshore wind turbine, using even at a significant wave height of up to 8 m, water depth of up to 15 m and current speed of approximately 2 m.

Another solution is presented in the patent document JP 2020190152A, which discloses a foundation structure of an offshore wind turbine and a supporting structure of the foundation, which may provide stable support for an offshore wind turbine using foundation based on a single pile foundation. The single pile load-bearing foundation structure of an offshore wind turbine includes: a wall section, located along the circumferential surface of the foundation pile, a through opening cut in a wall section passing through the foundation pile and a bottom surface running outside from the bottom end of the wall section.

Another known solution is disclosed in the publication of the European application EP 3502353A1, which discloses a foundation construction system for an offshore wind turbine, in which the monopile foundation is provided with a top section with the first connector the foundation platform unit, and a second, internal connector installing at least one electric unit of the platform inside the inner compartment of the monopile foundation, and a third connector for affixing the tower of the offshore wind turbine on the top of the platform unit. The top part according to this known solution is placed at least partially above the sea level, where the foundation platform encompasses the tower, while the electric unit of the platform includes at least one platform for electric equipment of the offshore wind turbine.

Another known solution is disclosed in the EP 3795823A1 document, which discloses a monopile foundation including hollow body, a shaft at the end, for introduction into the ground during monopile foundation penetration and an above-water section intended for affixing a structure, such a wind turbine tower. The working body of the monopile foundation is also provided with an inlet opening made in the body, providing access to the inside of the foundation.

A range of solutions related to the installation methods of a monopile foundation in the bottom of the basin are known.

The solution known from the disclosure of the European application EP 2372143A1 presents a solution related to a method of installation of a large, tall body, such as a monopile foundation for placement of a wind turbine in the sea. The method includes body placement in a horizontal position, at least partially below the working platform, attachment of a tensioning rope to the body and raising of said tensioning rope using attachments and guides, which are connected to the edge of the working platform.

The body is gradually placed vertically, near the edge of the working platform. The body is subsequently impaled into the bottom of the basin. The invention also pertains to a device for execution of this method.

Another known solution is known from the international application WO 2010/103114, which discloses a wind turbine construction method for a wind turbine consisting of a tower with a pre-fabricated bottom part, which is built before the tower is placed onto the foundation. The bottom part provides a housing for electric equipment. The prefabricated, bottom part of the tower for a wind turbine includes electric equipment placed on two or more levels.

Another known solution is presented in the patent document GB 2584958A. The installation method for an offshore structure for a wind turbine in a basin is executed by impaling modules of the monopile into the ground of the sea bottom. Subsequent elements are installed onto the monopile modules already introduced into the sea bottom. Connections between the working parts of the monopile are made using a connecting unit, using a liquid sealant in the sealing area between the monopile and the subsequent element, such that penetration of water surrounding the structure into the connecting unit is prevented. The liquid of the liquid sealant is not miscible with water and remains liquid in order to seal the connection and inhibit corrosion. As the liquid does not bind like a traditional sealant, the connection is less susceptible to damage. The sealing liquid may be a hydrophobic, non-aqueous, oil-based gel with density higher than that of water, containing a viscosity increasing additive. The equipment dosing the liquid may include in this known solution a tank containing the liquid delivered to the sealing area using a line, and a flow controlling device. Solid sealing elements are also provide,d which may additionally limit the sealing area, such that they prevent the mixing of the sealing liquid with the surrounding water.

BRIEF SUMMARY OF THE INVENTION

The objective of the invention is to develop of a new structure of a dry monopile foundation for structures installed in the bottom of a water basin. The monopile foundation is intended as a solution dedicated for marine structures, mainly offshore wind farms. The term dry monopile foundation means a monopile with a dry functional part of its interior.

In the previously known solutions of monopile foundations in offshore systems, the inner space of the pile is filled with the ground material from the basin bottom and with water, wherein the interior is a coherent, continuous volume, not separated with any barrier, thus preventing any functional use of the aforementioned space. The subject solution provides for the use of a tight membrane comprising a separating barrier inside the foundation pile. This solution provides for acquisition of strictly dry space, enabling functional use of the space with working devices, which may cooperate with or expand the functionality of working devices placed on the foundation. Example working devices, which may be installed in the dry interior of the monopile foundation, may include: energy storage devices, a cylindrical pressure tank with a gas generation and pumping module, cooling equipment cooperating with the working device or a water desalination module, wherein the dry functional space may be provided for a fresh water tank.

According to the invention, the monopile foundation has the form of a cylidnrical steel pipe intended for penetration into the bottom of the basis and includes the above-bottom section and the bottom section, wherein the above-bottom section is provided with a top connection flange.

According to the invention, the monopile foundation is characterised in that it is provided with a tight membrane comprising of a top panel and of a bottom panel located inside, with at least one reinforcing rib and a filling present between the panels. The monopile foundation includes a dry functional space above the membrane, located between the membrane and the top connection flange. The monopile foundation is provided with outlet openings below the bottom membrane panel. The space between the bottom membrane panel and the top edge of the outlet openings is an air cushion.

According to the invention, the dry functional space of the foundation monopile preferably includes the internal working infrastructure.

The working infrastructure is preferably placed on at least one level separated inside the monopile foundation by a working platform with at least one installed spreader beam.

The functional space of the interior of the above-bottom section of the monopile foundation is preferably filled with an inert gas.

The filling of the membrane between the top panel and the bottom panel is preferably a cement-based material.

In a preferred embodiment of the solution according to the invention, the working infrastructure is at least one energy storage unit.

In another preferred embodiment, the working infrastructure of the monopile foundation comprises at least one gas generating and pumping device, including a storage tank.

The working infrastructure may be provided in the form of at least one water desalinating device.

In another embodiment of the solution according to the invention, the working infrastructure may include at least one cooling device.

According to the invention, the monopile foundation installation method in the bottom of the basin includes the monopile foundation placement at the installation location, ensuring vertical position of the monopile foundation, which is then stabilised, followed by lowering the monopile foundation until it contacts the basin bottom and the monopile foundation is driven into the bottom of the basin, while a transport attachment is used to ensure vertical position and to lower the monopile foundation.

According to the invention, the monopile foundation method of installation in the bottom of the basin is characterised in that a surrounding clamp is attached before the monopile foundation is placed vertically in the bottom area, and a transport attachment is affixed to the connection flange of the monopile foundation. The monopile foundation is placed vertically, and once the monopile foundation is placed vertically, a geopositioning device is enclosed at its circumference and the monopile foundation is submerged into the basin. The monopile foundation is then driven into the bottom of the basin, wherein air and water containing sediments are removed outside the monopile foundation during the submersion and the driving, through outlet openings located below the bottom part of the membrane. The clamp is then unlocked and the monopile foundation is driven into the bottom of the basin by gravity and the transport attachment at the top of the monopile foundation is removed, and the transport attachment is replaced with a device intended for driving the monopile foundation into the bottom of the basin. The monopile foundation is driven into the target location, the clamp is removed and the monopile is weighed down such that the dry area of the interior of the monopile foundation located above the bottom, above the membrane, is equipped with the working infrastructure. The intermediate part is installed at the connection flange on the top of the monopile foundation, followed by the working device installed on it, and the part of the interior of the monopile foundation located above the bottom, containing the working infrastructure and above the membrane is filled with an inert gas.

Before the device driving the monopile foundation into the bottom of the basin is installed, a device generating an air curtain is preferably attached around the base of the monopile foundation, wherein air outlets of the device are directed towards the surface of the water basin.

According to the invention, the volume of the air cushion under the bottom membrane panel, above the outlet openings, is preferably filled during the installation of the monopile foundation.

The installation of the monopile foundation in the bottom of the basin should be understood as three stages: the stage of monopile submersion into the basin, the stage of monopile driving into the basin bottom and the stage of weighing down the monopile foundation through installation of working infrastructure, the intermediate part and the working device.

The position of the monopile foundation may be controlled digitally using a geopositioning device comprising a part of the on-board computer of the installation station.

The monopile foundation is preferably driven into the bottom of the basin using vibrations.

The monopile foundation is preferably driven into the bottom of the basin using impulses.

The monopile foundation according to the invention enables the above-bottom section of the monopile interior to remain strictly dry, thus ensuring area for installation of the working infrastructure inside the foundation monopile. This protects the devices against corrosive environment, especially at the sea.

The mass distribution of the dry monopile foundation, including the working infrastructure and the arrangement of the working infrastructure results in a higher rigidity and stability of the entire foundation structure. This enables shaping of the geometry of the dry monopile foundation which results in a much lower costs of execution and installation of the foundation compared to the corresponding solution using a classical monopile.

The membrane separating structurally the areas of the monopile additionally reinforces the structure through its structure made of elements welded together. The membrane is a steel structure filled with a cement-based material, filling a part of the described, cylindrical pipe. This structure reinforces the load-bearing parameters. The installation of the working infrastructure ensures weighing the monopile down, which facilitates rigidity and increases the mass of the structure.

The use of outlet openings discharging water and elements of the bottom, such as sand or gravel, enables technologically efficient driving of the monopile into the bottom of the basin, regardless of the technology selected to drive the foundation. Water and basin element discharging takes place via the outlet openings, including formation of an air cushion in the area between the bottom panel of the membrane and the top sections of the outlet opening edges. The air cushion decreases its volume during monopile driving into the bottom, as a result of pressure increase during monopile driving. Thanks to the compressibility of air present in the air cuship inside the monopile, under the membrane, the energy generated as a result of translational motion downwards is released through air decompression, and the air pushes a water volume corresponding to the translational movement outside. This enables the translational motion downwards with the present, tight membrane inside the monopile.

BRIEF DESCRIPTION OF THE SEVERAL VIEWS OF THE DRAWINGS

The object of the invention is presented in the attached figures in an embodiment, wherein the individual drawing figures illustrate as follows.

DETAILED DESCRIPTION OF THE INVENTION

Figure 1:
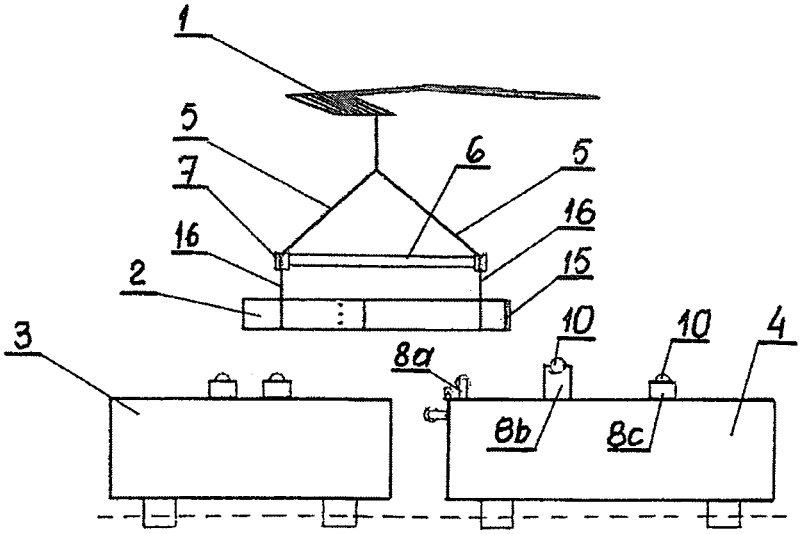
FIG. 1—Method of transport of the monopile foundation to the installation location.

FIG. 1 shows that during the initial stage, an installation crane 1 is used to transfer the monopile 2 from the delivery station 3 to the installation location 4. The installation location 4 in this embodiment is a jack-up vessel. In another embodiment, not shown in the attached figure, the installation location is a vessel equipped with a dynamic positioning and ballasting system. Transport takes place using the installation crane 1, wherein a traverse 6 is attached to the crane slings 5, with at least two crane slings 5 are attached to its opposite working ends 7, to which the monopile 2 is attached and transported using the installation crane 1 to the installation location 4.

In another embodiment, not shown in the attached figure, transport and vertical position of the monopile 2 are executed using a crane 1 provided as a separate installation location. In another embodiment, the delivery station 3 is provided as a transport barge, while a jack-up vessel is the installation location.

Figure 2:
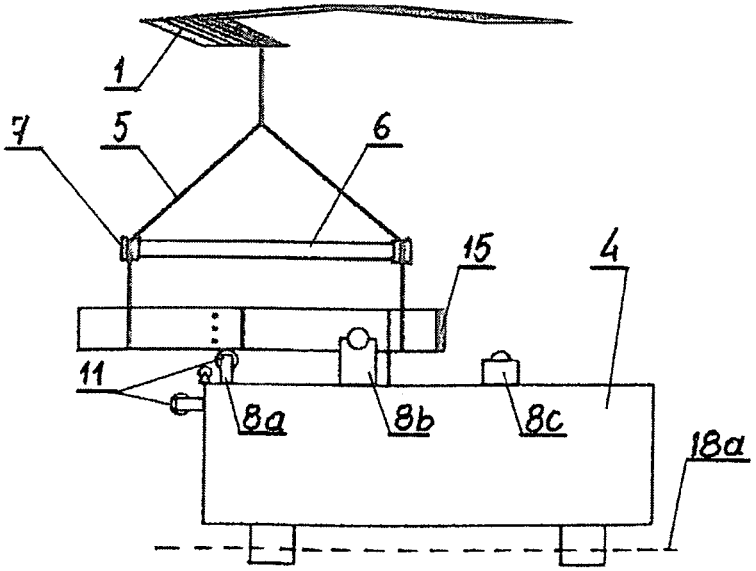
FIG. 2—The monopile at the installation location.

FIG. 2 shows the stage of monopile 2 placement at the installation location 4, where the monopile 2 is placed on supports 8*a* and 8*b* and secured using a tensioning strap 9, which is connected to the platform of the installation location 4. In another embodiment, the tensioning strap 9 may be connected to the support 8*b*. Next, the slings 5 and the traverse 6 are detached from the monopile 2 and the monopile 2 is left at the installation location 4, on the on-board support 8*b* containing a drum-type rope winch 10 and on the outer support 8*a* containing a set of guiding rollers 11.

Figure 3:
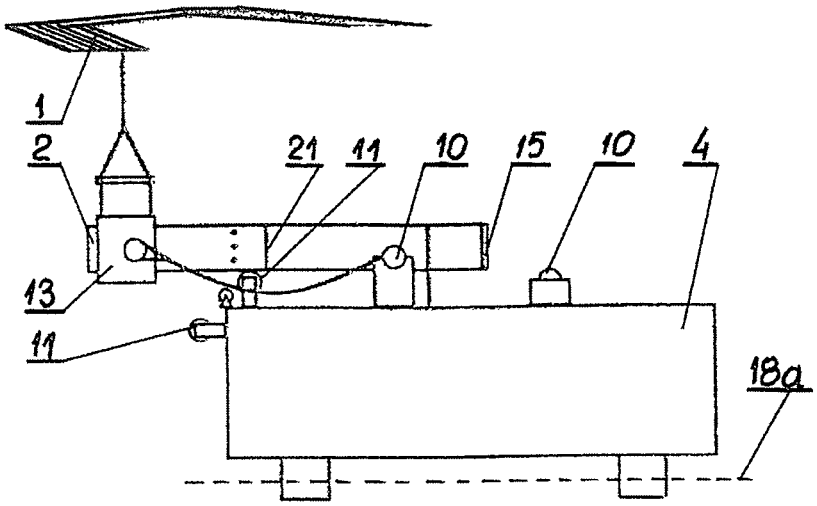
FIG. 3—Installation of the surrounding clamp.
Figure 4:
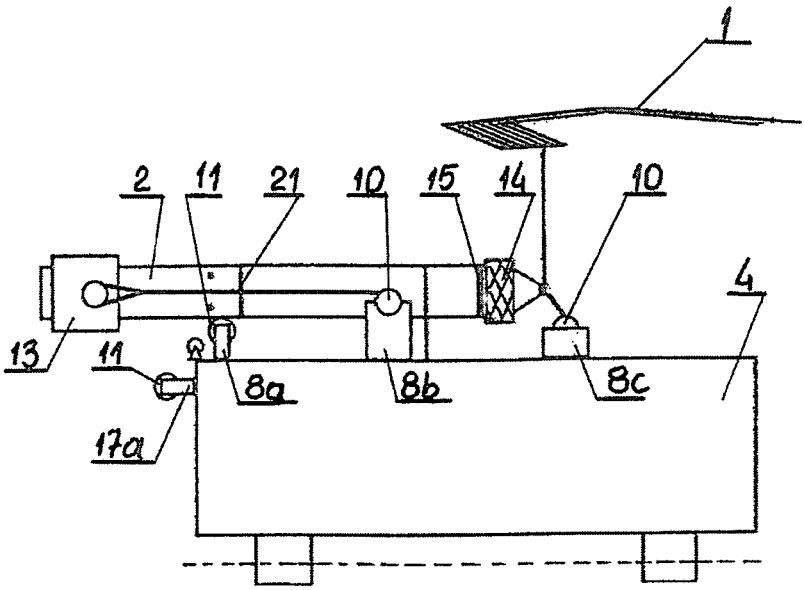
FIG. 4—Installation of the transport attachment.

FIG. 3 shows the next stage of monopile 2 placement, wherein the installation crane 1 is used to apply the surrounding clamp 13 in the bottom area 12 of the monopile 2, below the membrane 21. The transport is performed during the stage such that the surrounding clamp 13 is applied onto the monopile 2 using a crane sling 5 system attached to both working ends 7 of the traverse 6. Next, the ropes 16 of the drum-type winches 10 are attached to the hooks of the surrounding clamp 13. Once the ropes 16 are applied, the installation crane 1 is used to install the transport attachment 14 on the inner edge of the connection flange 15, as shown in FIG. 4 and the monopile is submerged in the water basin, as shown in FIG. 5.

Figure 5:
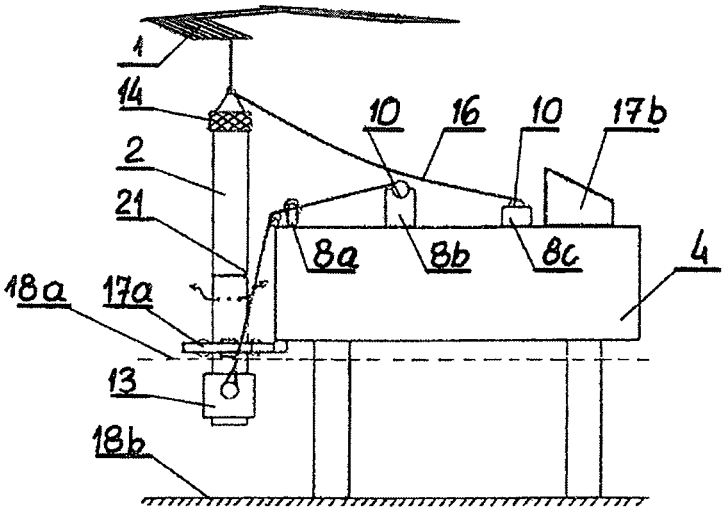
FIG. 5—The first stage of monopile submersion into the water basin.

FIG. 5 shows the initial submersion stage, during which the geopositoning device 17*a* is closed on the monopile circumference 2, thus enabling the motion of the monopile 2 upwards or downwards using an installation crane 1, wherein the geopositioning device 17*a* is controlled using the on-board computer 17*b*. Once the geoposition of the monopile 2 is determined, the monopile 2 is lowered further, while its vertical position is maintained. The monopile 2 is still supported by the installation crane 1, ropes 16 of the drum-type winches 10 and by the geopositioning device 17*a*.

Figure 6:
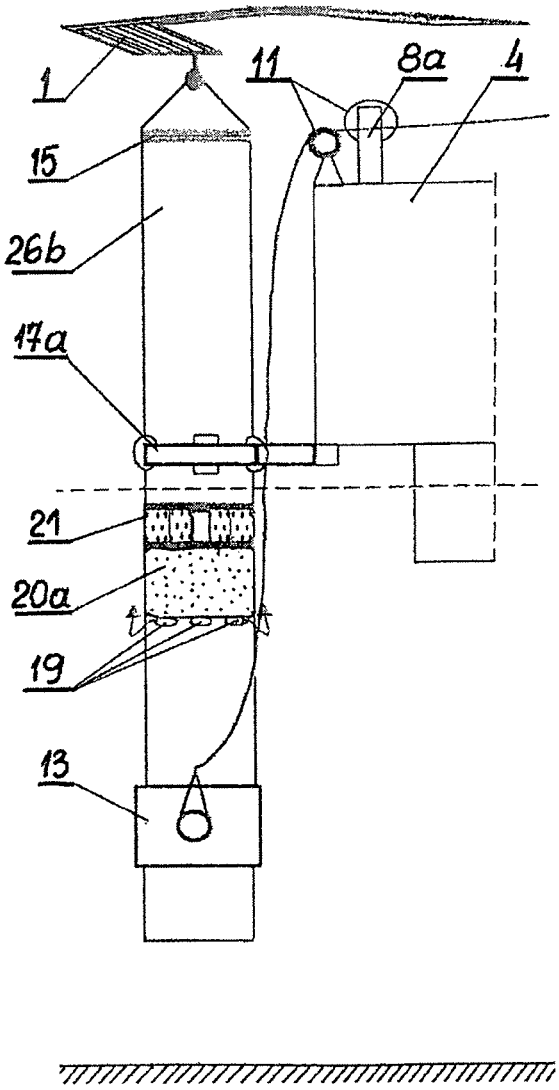
FIG. 6—The intermediate stage of submersion into the water basin with the air cushion shown.

FIG. 6 shows the intermediate stage of monopile 2 submersion at the bottom of the basin, where the monopile foundation 2 is further submersed towards the bottom of the basin 18*b*, such that work of the outlet openings 19 of the air cushion 20*a* is used to ensure smooth submersion of the monopile 2, such that the pressure inside the bottom area 12 of the monopile foundation 2 is adjusted by spotaneous creation of the air cushion 20*a* during submersion of the monopile foundation 2. The air cushion 20*a* is located above the edges of the outlet openings 19 and below the bottom panel 22 of the membrane 21.

Figure 7:
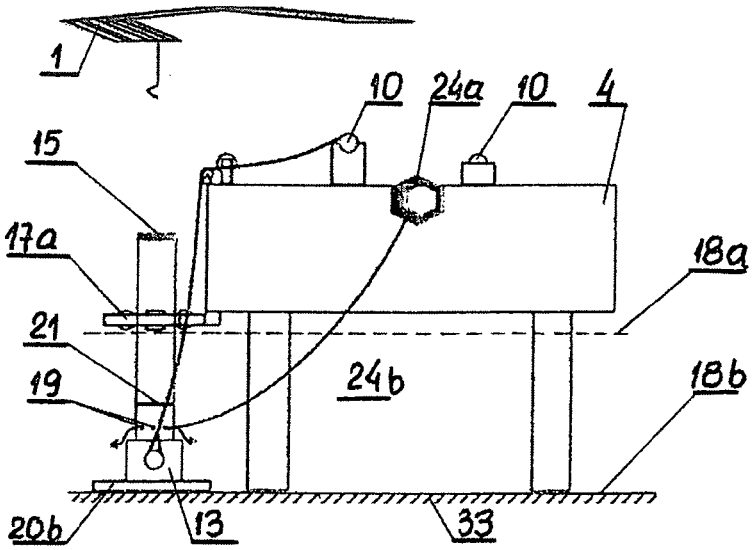
FIG. 7—The final stage of monopile submersion into the water basin.

During driving of the monopile 2 into the bottom of the basin 18*b* the air cushion 20*a* is subjected to increasing pressure and decreases its volume as a result of compressibility of air present inside the cushion. FIG. 6 additionally presents the submersion stage, wherein the monopile 2 is supported on the bottom of the basin 18*b* by the air cushion 20*a* resting on the inner water column reaching the area of outlet openings 19. During this stage, the monopile 2 is supported by the installation crane 1 and positioned using the geopositioning device 17*a*. In another embodiment, the volume of the air cushion 20*a* is adjusted through operation of a compressor 24*a*, such that lines of the air compressor 24*b* are introduced through the outlet openings 19, as shown in FIG. 7.

Figure 8:
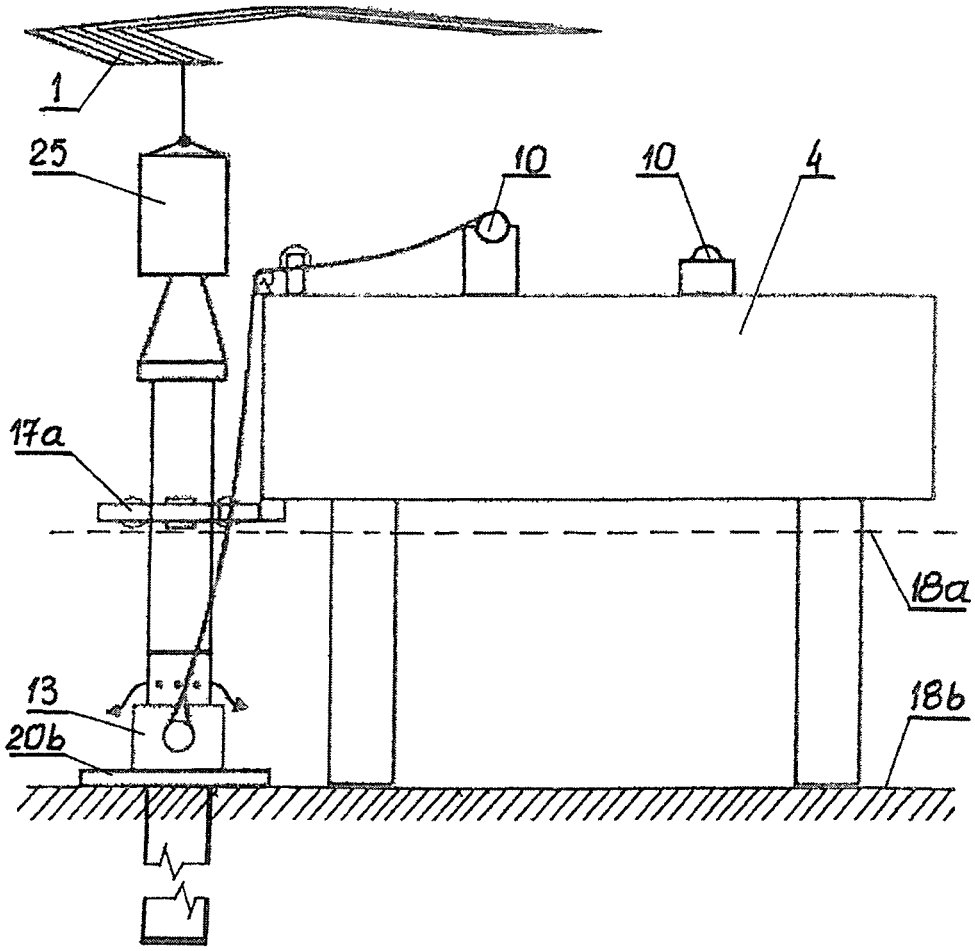
FIG. 8—Mechanical monopile drivng into the bottom of the basin.

FIG. 8 presents the next stage, where equipment is replaced by removing the transport attachment 14 at the top of the monopile and a device for impulse or vibration driving 25 of the monopole 2 in the bottom of the basin 18*b* is installed. A device generating an air curtain 20*b* is installed at the bottom of the basin 18*b*, around the monopile 2, wherein outlets of this device are directed towards the surface of the water basin.

Figure 9:
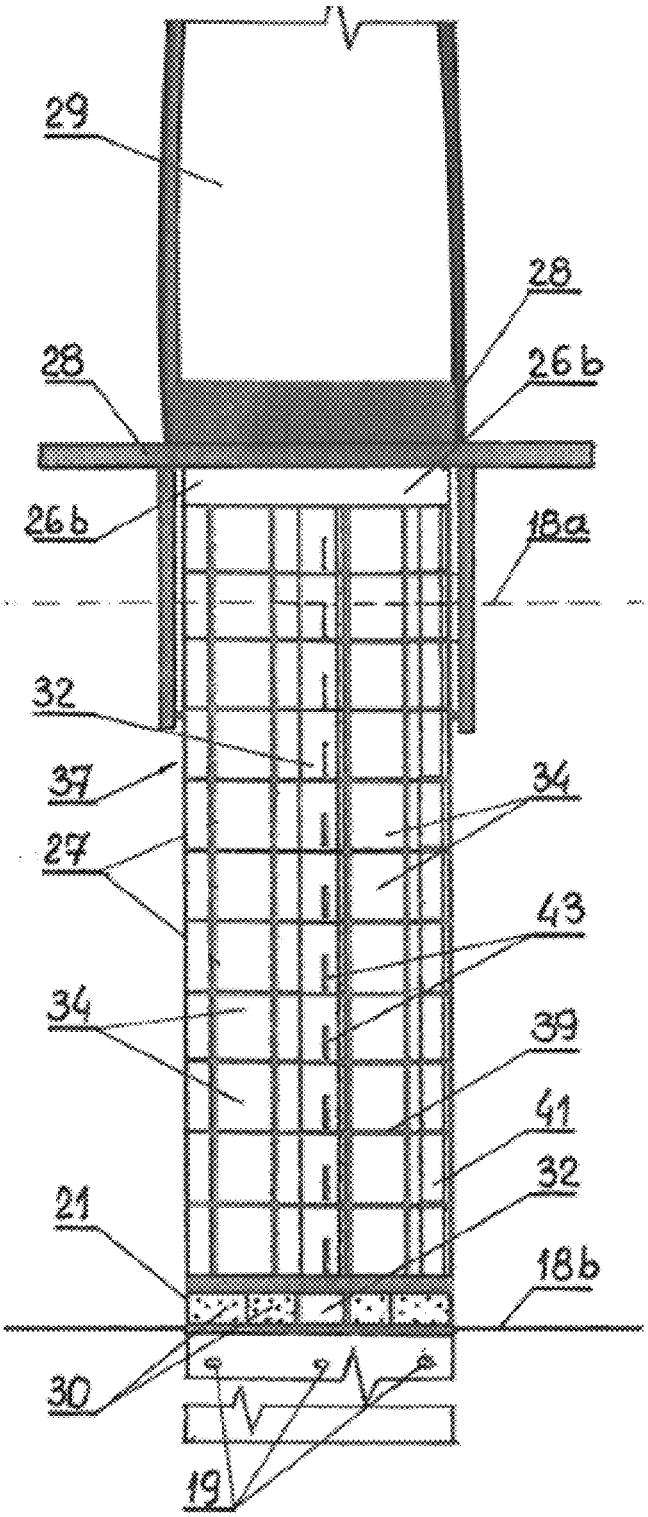
FIG. 9—The monopile with the working infrastructure in the form of energy storage units.

The next FIG. 9 shows the stage, where the geopositioning device 17*a*, the ropes 16 and the clamp 13 are removed and the monopile 2 is left driven into the bottom of the basin 18*b*, at the target location, while the dry functional space 26*b* is then equipped with the working infrastructure 27, while the intermediate part 28 is installed onto the connection flange 15. In this embodiment, an electricity storage unit 34 comprises the working infrastructure 27. The intermediate part 28 of the foundation should be understood as a structure attached to the connection flange 15 of the monopile 2, and the working device 29 is installed on the intermediate part 28. At the end of the installation and after trial runs of the equipment, the dry zone above the bottom 26*a* is filled with an inert gas. In this embodiment, the working device 29 is provided as a wind turbine.

Figure 10:
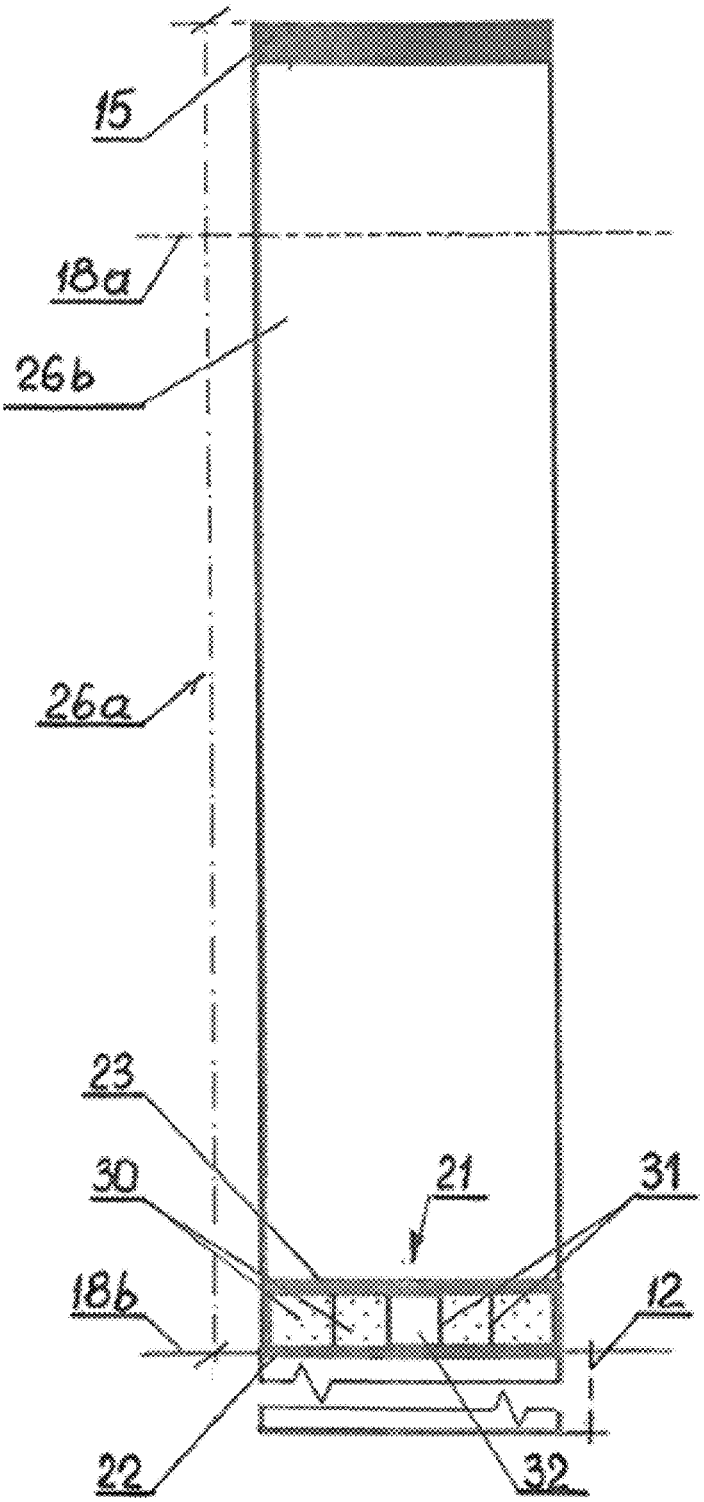
FIG. 10—The monopile driven into the bottom of the basin, before installation of the working infrastructure.

In the embodiment of the invention shown in FIG. 10, structural elements of the monopile foundation 2 are shown. In this embodiment, the monopile foundation 2 contains a membrane 21 in the area above the bottom, comprised of the bottom panel 22 and the top panel 23. The membrane 21 should be understood as an impenetrable barrier between the area above the bottom 26*a* and the bottom area 12 of the monopile foundation 2, with a filling 30 comprising a cement-based material and stiffening elements in the form of reinforcing ribs 31. The filling 30 is located between the bottom panel of the membrane 22 and its top panel 23. In this embodiment, the filling 30 is made of concrete. The monopile has an above-bottom area 26*a* above the membrane, intended for installation of the working infrastructure 27. In the bottom area 12 of the monopile foundation 2 structure, near the bottom membrane panel 22, there are outlet openings 19 for water and air used during monopile 2 placement in the bottom of the water basin.

FIG. 11 to FIG. 14 present management of the dry functional space 26*b* inside the area above the bottom 26*a* of the monopile 2. In the embodiment of the invention according to FIG. 11, the configuration includes the working infrastructure 27 in the form of electricity storage units 34. The layout of the electricity storage units 34 is presented in this embodiment as a modular system, in the form of two sets of batteries 35 per one level module 36, placed vertically on individual levels 37 inside the dry area above the bottom 26*a*. In this embodiment, each level 37 includes a working platform 39 containing two sets of batteries 35 in each set, provided as a block. The level module 36 is also separated in this embodiment with a working platform 39, used to traverse the level module 36.

Figure 11:
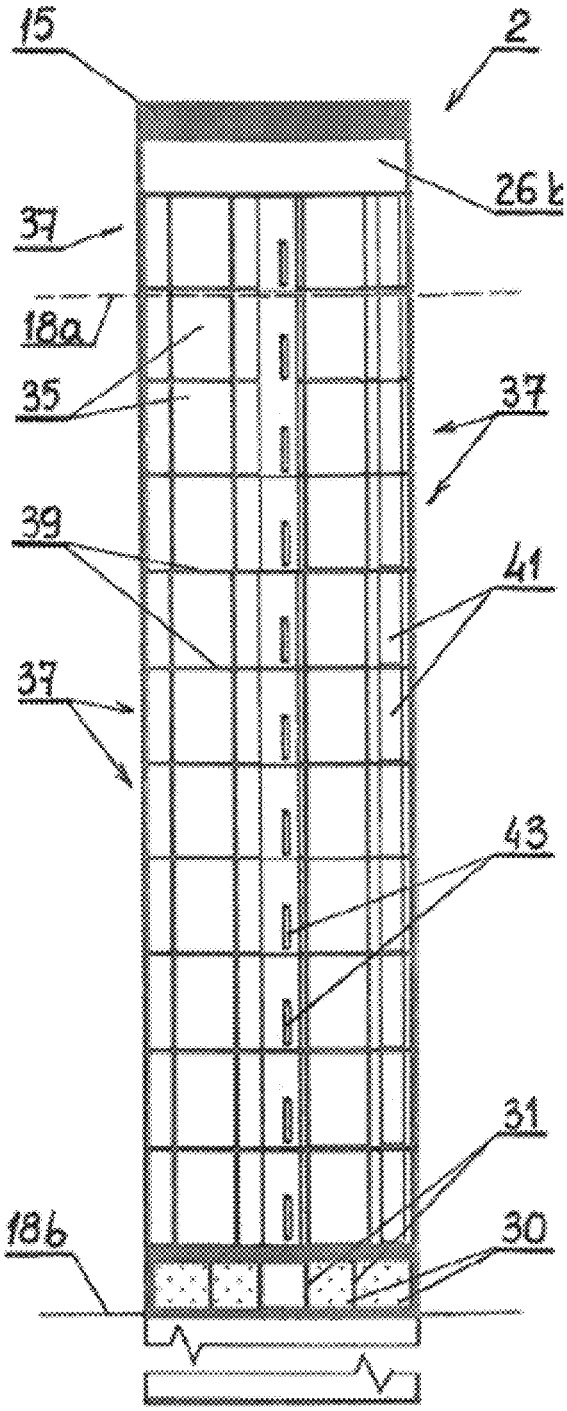
FIG. 11—Longitudinal cross-section of the monopile foundation driven into the bottom of the basin with working infrastructure in the form of electricity storage units.
Figure 12:
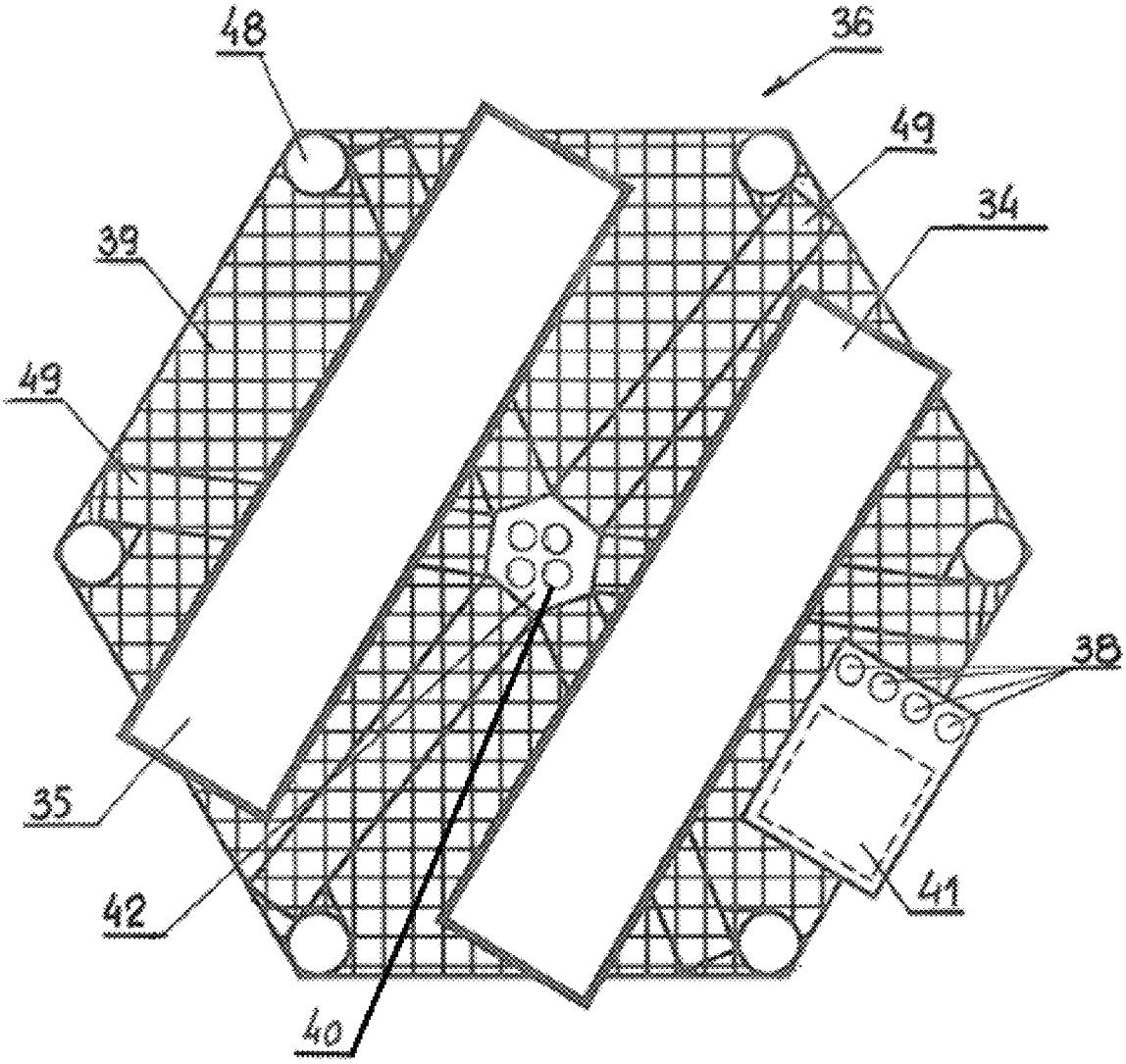
FIG. 12—Level module including two energy storage units on a single working platform.

The level module 36 in the embodiment according to FIG. 12 includes the main cable duct 40, the cable duct 38 and the transport duct 41 used to transport the service technicians and the equipment between level modules 36. Each of the level modules 36 additionally includes a centrally placed column fragment 42 with an inspection manhole 43, as shown in FIG. 11 and FIG. 12. Individual level modules 36 are connected with one another using connecting columns 48, as shown in FIGS. 11 and 12.

Figure 13:
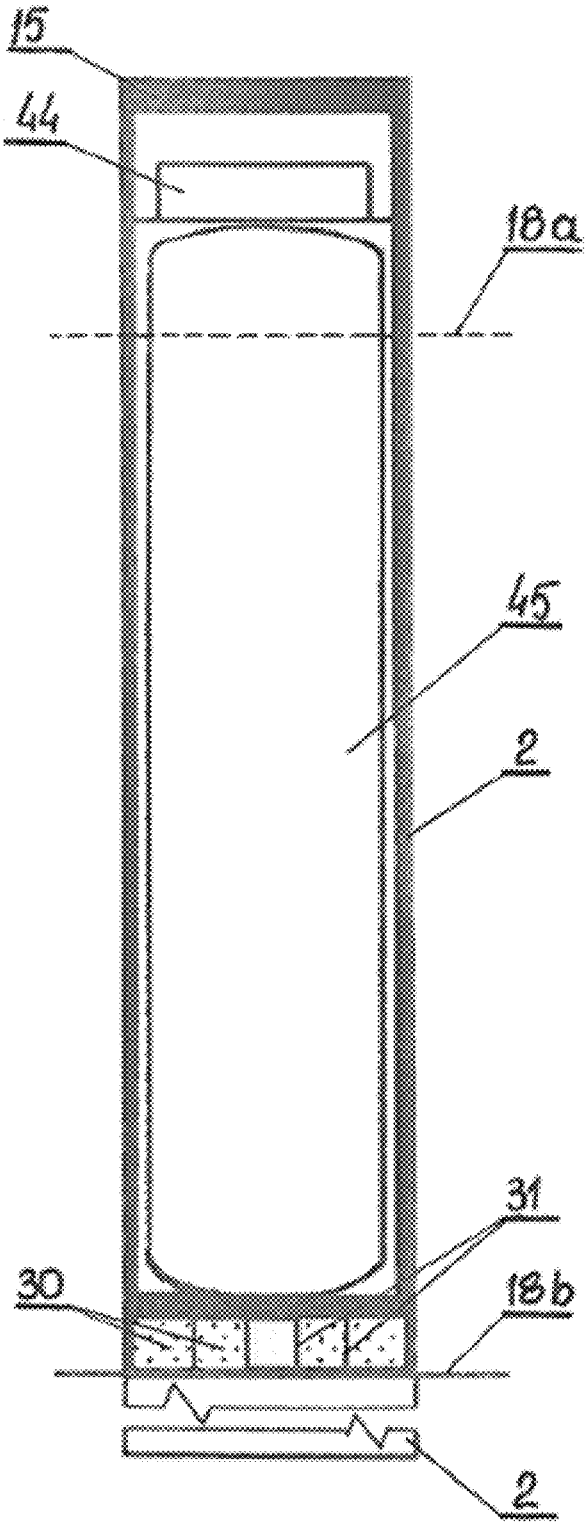
FIG. 13—Monopile containing the working infrastructure for gas generation and storage.
Figure 14:
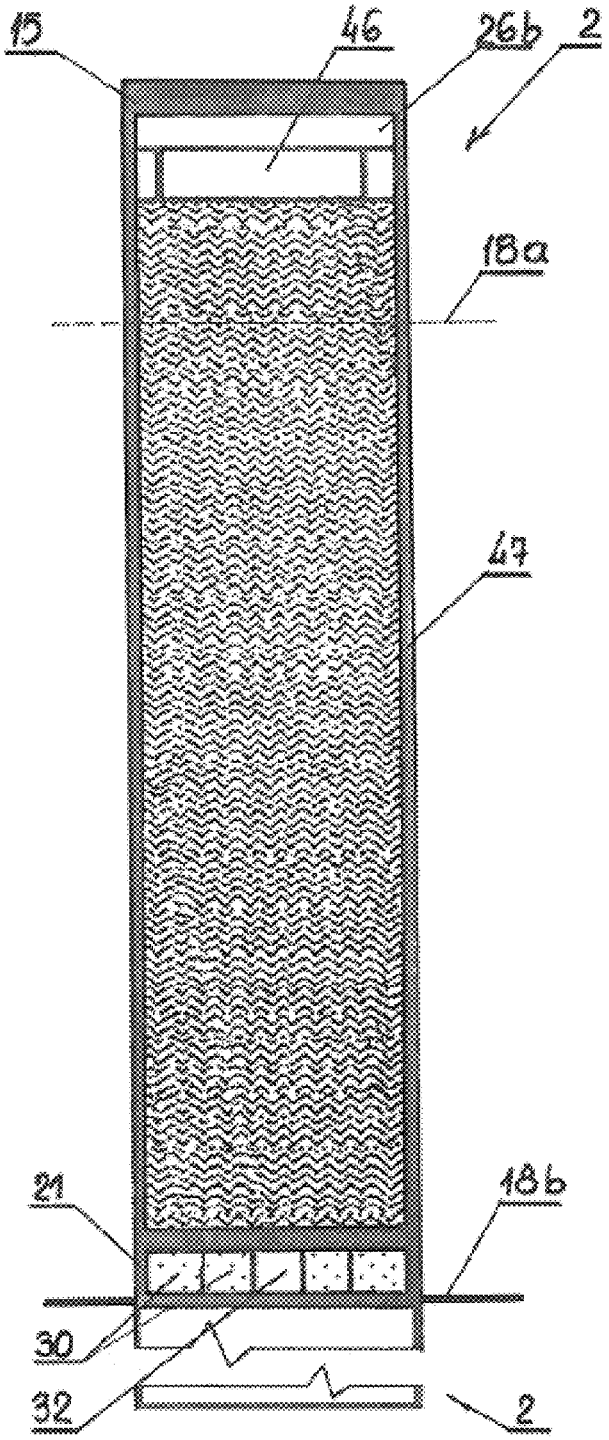
FIG. 14—Monopile containing the working infrastructure for fresh water generation and storage.

In another embodiment of the invention shown in FIG. 13, the layout inside the monopile 2, in the area above the bottom 26*a* shown in FIG. 10 was executed as internal installation, as working infrastructure 27 in the form of a module generating, pumping and storing gas 44 and a gas pressure tank 45. In this embodiment, the generated and stored gas is hydrogen. In another embodiment, this may be ammonia or other gases. Another example of the layout of working infrastructure 27 may include a device generating and storing fresh water, in the form of a desalination module 46 and a storage space for fresh water 47, as shown in FIG. 14.

In a different embodiment, the working infrastructure 27 may include sets of other equipment, for example cooling equipment.

As a general rule, the listed example equipment comprising the working infrastrcuture 27 inside the monopile 2 are supplied with electricity from the workign device 29 installed at the top of the monopile foundation 2 according to the invention. The described embodiments do not exhaust other example solutions of the monopile 2 according to the invention, both in terms of its design and its layout intended to provide its dry interior for use.

LIST OF REFERENCES

1. Installation crane
2. Monopile foundation
3. Delivery station
4. Installation location
5. Crane slings
6. Traverse
7. Working end
8*a* End support
8*b*. On-board support
8*c*. Support
9. Tensioning strap

10. Drum-type winch
11. Guiding roller set
12. Bottom area
13. Surrounding clamp
14. Transport attachment
15. Connection flange
16. Rope
17*a*. Geopositioning device
17*b*. On-board computer
18*a*. Water line
18*b*. Bottom of the basin
19. Outlet opening
20*a* Air cushion
20*b* Air curtain
21. Membrane
22. Bottom panel of the membrane
23. Top panel of the membrane
24*a*. Compressor
24*b*. Air compressor lines
25. Device for driving
26*a*. Area above the bottom
26*b*. Dry functional space
27. Working infrastructure
28. Intermediate part
29. Working device
30. Filling
31 Reinforcing rib
32. Reinforcing-stiffening column
33. Structure of the bottom of the basin
34. Electricity storage unit
35. Battery set
36. Level module
37. Level
38. Cable duct
39. Working platform
40. Main cable duct
41. Transport duct
42. Column piece
43. Inspection manhole
44. Gas generating and pumping module
45. Gas pressure tank
46. Desalination module
47. Fresh water storage space
48. Connecting column
49. Spreader beam

The invention claimed is:

1. A monopile foundation in a form of a cylindrical steel pipe intended for driving into a bottom of a water basin, including an area above the bottom and a bottom area, wherein the area above the bottom includes a connection flange wherein the monopile foundation in the area above the bottom includes a tight membrane inside, consisting of a bottom panel and of a top panel with at least one reinforcing rib and filling between the panels, wherein above the membrane, the monopile foundation contains dry functional space between the membrane and a top connection flange, while in the bottom area of the monopile foundation, below the bottom panel of the membrane, in the cylindrical steel pipe of the monopile foundation outlet openings are present, wherein a space between the bottom panel of the membrane and a top edge of the outlet openings is filled by an air cushion.

2. The monopile foundation according to claim 1, wherein the dry functional space of the monopile foundation contains an internal working infrastructure.

3. The monopile foundation according to claim 2, wherein the working infrastructure is located on at least one level separated inside the monopile foundation by a working platform with at least one spreader beam installed on the working platform.

4. The monopile foundation according to claim 1, wherein a functional space inside the area above the bottom of the monopile foundation is filled with an inert gas.

5. The monopile foundation according to claim 1, wherein the filling of the membrane, between the bottom panel and the top panel is a cement-based material.

6. The monopile foundation according to claim 2, wherein the working infrastructure includes at least one energy storage unit.

7. The monopile foundation according to claim 2, wherein the working infrastructure includes at least one device generating and pumping gas, including a storage tank.

8. The monopile foundation according to claim 2, wherein the working infrastructure includes at least one water desalination device.

9. The monopile foundation according to claim 2, wherein the working infrastructure includes at least one cooling device.

10. An installation method for a monopile foundation in a bottom of a water basin, comprising:

placing the monopile foundation at an installation station, placed vertically and stabilized in position, bringing the monopile foundation into contact with the bottom of the water basin, driving the monopile foundation into the bottom of the basin, wherein the placing and bringing of the monopile foundation are executed using a surrounding clamp, before placing the monopile foundation vertically in a bottom area, attaching the surrounding clamp and an attachment to a connection flange of the monopile foundation and placing the monopile foundation vertically, once the monopile foundation is placed vertically, closing a geopositioning device on a circumference of the monopole foundation and submerging the monopile foundation in the water basin, and then driving the monopile foundation into the bottom of the basin, wherein during the submerging and driving, air and water with sediments are discharged outside the monopile foundation through outlet openings located below a bottom panel of a membrane, once the monopile foundation is driven under gravity, releasing the clamp and removing the attachment, installing at a top of the monopile foundation a driving device for the monopile foundation in the bottom of the basin and driving the monopile foundation mechanically to a target location, removing the clamp while the monopile foundation is weighed down, wherein a dry area is defined above the bottom inside the monopile foundation, and working infrastructure is provided above the membrane, and installing an intermediate part on the connection flange at the top of the monopile foundation and installing a working device on said part while the area above the bottom inside the monopile foundation above the membrane is filled with an inert gas.

11. The installation method according to claim 10, wherein before the driving device for the monopile is installed, a device generating an air curtain is installed at the bottom of the basin, around the base of the monopile, wherein the air outlets from the device are directed towards a surface of the basin.

12. The installation method according to claim 11, wherein the volume of an air cushion under the bottom panel of the membrane, above the outlet openings is filled during installation of the monopile foundation.

13. The installation method according to claim 11, wherein the position of the monopile foundation is controlled digitally using a geopositioning device comprising a part of an on-board computer of an installation location.

14. The installation method according to claim 11, wherein the monopile foundation is driven mechanically into the bottom of the basin using vibration technology.

15. The installation method according to claim 11, wherein the monopile foundation is driven mechanically into the bottom of the basin using impulse technology.

* * * * *